US009429865B2

(12) United States Patent
Kidaka

(10) Patent No.: US 9,429,865 B2
(45) Date of Patent: Aug. 30, 2016

(54) IMAGE FORMING APPARATUS

(71) Applicant: CANON KABUSHIKI KAISHA, Tokyo (JP)

(72) Inventor: Hiroyuki Kidaka, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/987,993

(22) Filed: Jan. 5, 2016

(65) Prior Publication Data

US 2016/0202627 A1 Jul. 14, 2016

(30) Foreign Application Priority Data

Jan. 8, 2015 (JP) ..... 2015-002615

(51) Int. Cl.
*G03G 15/02* (2006.01)

(52) U.S. Cl.
CPC ..... *G03G 15/0266* (2013.01)

(58) Field of Classification Search
None
See application file for complete search history.

(56) References Cited

U.S. PATENT DOCUMENTS

2004/0218939 A1* 11/2004 Motohashi ..... G03G 15/0266 399/50
2005/0002681 A1* 1/2005 Takahashi ..... G03G 15/0266 399/50
2007/0166066 A1* 7/2007 Kitano ..... G03G 15/0266 399/50
2007/0297819 A1* 12/2007 Hagiwara ..... G03G 15/0266 399/44
2010/0221026 A1* 9/2010 Komatsu ..... G03G 15/0266 399/50
2014/0147140 A1* 5/2014 Shirakata ..... G03G 15/0266 399/50

FOREIGN PATENT DOCUMENTS

JP 2010-231188 A 10/2010

* cited by examiner

*Primary Examiner* — David Gray
*Assistant Examiner* — Thomas Giampaolo, II
(74) *Attorney, Agent, or Firm* — Canon USA, Inc. IP Division

(57) ABSTRACT

An image forming apparatus includes an image-bearing member, which is charged by a charge voltage in which direct and alternating-current voltages are superposed on each other. A toner image is formed on the charged image-bearing member. A current flowing through the charging member is detected when the charge voltage is applied to the charging member. A current, in a frequency band including a discharge current component, is extracted from the detected current. The alternating-current voltage is adjusted based on the current extracted by an extraction unit. Environmental information is acquired. Based on the environmental information acquired by an acquisition unit, a frequency band for extraction performed by the extraction unit is set.

10 Claims, 17 Drawing Sheets

FIG. 8

| TEMPERATURE 5 °C | | | |
|---|---|---|---|
| TOTAL OUTPUT PRINT PAGES (10^3 PAGES) | DISCHARGE START VOLTAGE Vth (V) | VOLTAGE AMPLITUDE AVAILABLE FOR OBTAINING TARGET DISCHARGE-CURRENT AMOUNT Vot (V) | SET FREQUENCY BAND (Hz) |
| 0 | 740 | 980 | 4394 |
| 50 | 730 | 970 | 4370 |
| 100 | 720 | 960 | 4347 |
| 150 | 710 | 950 | 4323 |
| 200 | 700 | 940 | 4299 |
| 250 | 690 | 930 | 4275 |
| 300 | 680 | 920 | 4251 |

| TEMPERATURE 10 °C | | | |
|---|---|---|---|
| TOTAL OUTPUT PRINT PAGES (10^3 PAGES) | DISCHARGE START VOLTAGE Vth (V) | VOLTAGE AMPLITUDE AVAILABLE FOR OBTAINING TARGET DISCHARGE-CURRENT AMOUNT Vot (V) | SET FREQUENCY BAND (Hz) |
| 0 | 720 | 950 | 4420 |
| 50 | 710 | 940 | 4396 |
| 100 | 700 | 930 | 4371 |
| 150 | 690 | 920 | 4347 |
| 200 | 680 | 910 | 4322 |
| 250 | 670 | 900 | 4297 |
| 300 | 660 | 890 | 4272 |

| TEMPERATURE 20 °C | | | |
|---|---|---|---|
| TOTAL OUTPUT PRINT PAGES (10^3 PAGES) | DISCHARGE START VOLTAGE Vth (V) | VOLTAGE AMPLITUDE AVAILABLE FOR OBTAINING TARGET DISCHARGE-CURRENT AMOUNT Vot (V) | SET FREQUENCY BAND (Hz) |
| 0 | 700 | 900 | 4622 |
| 50 | 690 | 890 | 4595 |
| 100 | 680 | 880 | 4568 |
| 150 | 670 | 870 | 4541 |
| 200 | 660 | 860 | 4514 |
| 250 | 650 | 850 | 4487 |
| 300 | 640 | 840 | 4459 |

| TEMPERATURE 30 °C | | | |
|---|---|---|---|
| TOTAL OUTPUT PRINT PAGES (10^3 PAGES) | DISCHARGE START VOLTAGE Vth (V) | VOLTAGE AMPLITUDE AVAILABLE FOR OBTAINING TARGET DISCHARGE-CURRENT AMOUNT Vot (V) | SET FREQUENCY BAND (Hz) |
| 0 | 680 | 800 | 5662 |
| 50 | 670 | 790 | 5626 |
| 100 | 660 | 780 | 5589 |
| 150 | 650 | 770 | 5552 |
| 200 | 640 | 760 | 5515 |
| 250 | 630 | 750 | 5478 |
| 300 | 620 | 740 | 5440 |

FIG. 9

| RELATIVE HUMIDITY 5 % | | | |
|---|---|---|---|
| PHOTOCONDUCTOR DRUM ROTATION TIME (h) | DISCHARGE START VOLTAGE Vth (V) | VOLTAGE AMPLITUDE AVAILABLE FOR OBTAINING TARGET DISCHARGE-CURRENT AMOUNT Vot (V) | SET FREQUENCY BAND (Hz) |
| 0 | 750 | 980 | 4493 |
| 62.5 | 740 | 970 | 4469 |
| 125 | 730 | 960 | 4445 |
| 187.5 | 720 | 950 | 4420 |
| 250 | 710 | 940 | 4396 |
| 312.5 | 700 | 930 | 4371 |
| 375 | 690 | 920 | 4347 |

| RELATIVE HUMIDITY 20 % | | | |
|---|---|---|---|
| PHOTOCONDUCTOR DRUM ROTATION TIME (h) | DISCHARGE START VOLTAGE Vth (V) | VOLTAGE AMPLITUDE AVAILABLE FOR OBTAINING TARGET DISCHARGE-CURRENT AMOUNT Vot (V) | SET FREQUENCY BAND (Hz) |
| 0 | 730 | 950 | 4524 |
| 62.5 | 720 | 940 | 4499 |
| 125 | 710 | 930 | 4474 |
| 187.5 | 700 | 920 | 4449 |
| 250 | 690 | 910 | 4424 |
| 312.5 | 680 | 900 | 4398 |
| 375 | 670 | 890 | 4373 |

| RELATIVE HUMIDITY 50 % | | | |
|---|---|---|---|
| PHOTOCONDUCTOR DRUM ROTATION TIME (h) | DISCHARGE START VOLTAGE Vth (V) | VOLTAGE AMPLITUDE AVAILABLE FOR OBTAINING TARGET DISCHARGE-CURRENT AMOUNT Vot (V) | SET FREQUENCY BAND (Hz) |
| 0 | 700 | 900 | 4622 |
| 62.5 | 690 | 890 | 4595 |
| 125 | 680 | 880 | 4568 |
| 187.5 | 670 | 870 | 4541 |
| 250 | 660 | 860 | 4514 |
| 312.5 | 650 | 850 | 4487 |
| 375 | 640 | 840 | 4459 |

| RELATIVE HUMIDITY 80 % | | | |
|---|---|---|---|
| PHOTOCONDUCTOR DRUM ROTATION TIME (h) | DISCHARGE START VOLTAGE Vth (V) | VOLTAGE AMPLITUDE AVAILABLE FOR OBTAINING TARGET DISCHARGE-CURRENT AMOUNT Vot (V) | SET FREQUENCY BAND (Hz) |
| 0 | 660 | 780 | 5589 |
| 62.5 | 650 | 770 | 5552 |
| 125 | 640 | 760 | 5515 |
| 187.5 | 630 | 750 | 5478 |
| 250 | 620 | 740 | 5440 |
| 312.5 | 610 | 730 | 5402 |
| 375 | 600 | 720 | 5364 |

FIG. 10

| ABSOLUTE HUMIDITY 1.5 g/m$^3$ | | | |
|---|---|---|---|
| CHARGE VOLTAGE APPLICATION TIME (h) | DISCHARGE START VOLTAGE Vth (V) | VOLTAGE AMPLITUDE AVAILABLE FOR OBTAINING TARGET DISCHARGE-CURRENT AMOUNT Vot (V) | SET FREQUENCY BAND (Hz) |
| 0 | 740 | 960 | 4549 |
| 50 | 730 | 950 | 4524 |
| 100 | 720 | 940 | 4499 |
| 150 | 710 | 930 | 4474 |
| 200 | 700 | 920 | 4449 |
| 250 | 690 | 910 | 4424 |
| 300 | 680 | 900 | 4398 |

| ABSOLUTE HUMIDITY 10.0 g/m$^3$ | | | |
|---|---|---|---|
| CHARGE VOLTAGE APPLICATION TIME (h) | DISCHARGE START VOLTAGE Vth (V) | VOLTAGE AMPLITUDE AVAILABLE FOR OBTAINING TARGET DISCHARGE-CURRENT AMOUNT Vot (V) | SET FREQUENCY BAND (Hz) |
| 0 | 720 | 930 | 4584 |
| 50 | 710 | 920 | 4558 |
| 100 | 700 | 910 | 4532 |
| 150 | 690 | 900 | 4506 |
| 200 | 680 | 890 | 4480 |
| 250 | 670 | 880 | 4454 |
| 300 | 660 | 870 | 4427 |

| ABSOLUTE HUMIDITY 18.0 g/m$^3$ | | | |
|---|---|---|---|
| CHARGE VOLTAGE APPLICATION TIME (h) | DISCHARGE START VOLTAGE Vth (V) | VOLTAGE AMPLITUDE AVAILABLE FOR OBTAINING TARGET DISCHARGE-CURRENT AMOUNT Vot (V) | SET FREQUENCY BAND (Hz) |
| 0 | 680 | 850 | 4882 |
| 50 | 670 | 840 | 4852 |
| 100 | 660 | 830 | 4822 |
| 150 | 650 | 820 | 4792 |
| 200 | 640 | 810 | 4762 |
| 250 | 630 | 800 | 4731 |
| 300 | 620 | 790 | 4700 |

| ABSOLUTE HUMIDITY 25.0 g/m$^3$ | | | |
|---|---|---|---|
| CHARGE VOLTAGE APPLICATION TIME (h) | DISCHARGE START VOLTAGE Vth (V) | VOLTAGE AMPLITUDE AVAILABLE FOR OBTAINING TARGET DISCHARGE-CURRENT AMOUNT Vot (V) | SET FREQUENCY BAND (Hz) |
| 0 | 640 | 770 | 5328 |
| 50 | 630 | 760 | 5293 |
| 100 | 620 | 750 | 5257 |
| 150 | 610 | 740 | 5220 |
| 200 | 600 | 730 | 5184 |
| 250 | 590 | 720 | 5147 |
| 300 | 580 | 710 | 5110 |

FIG. 12

| ABSOLUTE HUMIDITY 10.0 g/m$^3$ | | | | |
|---|---|---|---|---|
| DETECTED AC EFFECTIVE VALUE (μA) | IMPEDANCE (MΩ) | DISCHARGE START VOLTAGE Vth (V) | VOLTAGE AMPLITUDE AVAILABLE FOR OBTAINING TARGET DISCHARGE-CURRENTAMOUNT Vot (V) | SET FREQUENCY BAND (Hz) |
| 1700 | 1.06 | 740 | 960 | 4549 |
| 1725 | 1.04 | 733 | 953 | 4536 |
| 1750 | 1.03 | 725 | 945 | 4512 |
| 1775 | 1.01 | 718 | 938 | 4498 |
| 1800 | 1.00 | 710 | 930 | 4474 |
| 1825 | 0.99 | 703 | 923 | 4461 |
| 1850 | 0.97 | 695 | 915 | 4436 |
| 1875 | 0.96 | 688 | 908 | 4423 |
| 1900 | 0.95 | 680 | 900 | 4398 |

| ABSOLUTE HUMIDITY 10.0 g/m$^3$ | | | | |
|---|---|---|---|---|
| DETECTED AC EFFECTIVE VALUE (μA) | IMPEDANCE (MΩ) | DISCHARGE START VOLTAGE Vth (V) | VOLTAGE AMPLITUDE AVAILABLE FOR OBTAINING TARGET DISCHARGE-CURRENTAMOUNT Vot (V) | SET FREQUENCY BAND (Hz) |
| 1700 | 1.06 | 720 | 930 | 4584 |
| 1725 | 1.04 | 713 | 923 | 4570 |
| 1750 | 1.03 | 705 | 915 | 4545 |
| 1775 | 1.01 | 698 | 908 | 4531 |
| 1800 | 1.00 | 690 | 900 | 4506 |
| 1825 | 0.99 | 683 | 893 | 4492 |
| 1850 | 0.97 | 675 | 885 | 4467 |
| 1875 | 0.96 | 668 | 878 | 4453 |
| 1900 | 0.95 | 660 | 870 | 4427 |

| ABSOLUTE HUMIDITY 18.0 g/m$^3$ | | | | |
|---|---|---|---|---|
| DETECTED AC EFFECTIVE VALUE (μA) | IMPEDANCE (MΩ) | DISCHARGE START VOLTAGE Vth (V) | VOLTAGE AMPLITUDE AVAILABLE FOR OBTAINING TARGET DISCHARGE-CURRENTAMOUNT Vot (V) | SET FREQUENCY BAND (Hz) |
| 1700 | 1.06 | 680 | 850 | 4882 |
| 1725 | 1.04 | 673 | 843 | 4867 |
| 1750 | 1.03 | 665 | 835 | 4837 |
| 1775 | 1.01 | 658 | 828 | 4822 |
| 1800 | 1.00 | 650 | 820 | 4792 |
| 1825 | 0.99 | 643 | 813 | 4776 |
| 1850 | 0.97 | 635 | 805 | 4746 |
| 1875 | 0.96 | 628 | 798 | 4730 |
| 1900 | 0.95 | 620 | 790 | 4700 |

| ABSOLUTE HUMIDITY 25.0 g/m$^3$ | | | | |
|---|---|---|---|---|
| DETECTED AC EFFECTIVE VALUE (μA) | IMPEDANCE (MΩ) | DISCHARGE START VOLTAGE Vth (V) | VOLTAGE AMPLITUDE AVAILABLE FOR OBTAINING TARGET DISCHARGE-CURRENTAMOUNT Vot (V) | SET FREQUENCY BAND (Hz) |
| 1700 | 1.06 | 640 | 770 | 5328 |
| 1725 | 1.04 | 633 | 763 | 5312 |
| 1750 | 1.03 | 625 | 755 | 5275 |
| 1775 | 1.01 | 618 | 748 | 5258 |
| 1800 | 1.00 | 610 | 740 | 5220 |
| 1825 | 0.99 | 603 | 733 | 5203 |
| 1850 | 0.97 | 595 | 725 | 5166 |
| 1875 | 0.96 | 588 | 718 | 5148 |
| 1900 | 0.95 | 580 | 710 | 5110 |

FIG. 15

| TEMPERATURE 5 °C | | | |
|---|---|---|---|
| TOTAL OUTPUT PRINT PAGES (10^3 PAGES) | DISCHARGE START VOLTAGE Vth (V) | VOLTAGE AMPLITUDE AVAILABLE FOR OBTAINING TARGET DISCHARGE-CURRENT AMOUNT Vot (V) | SELECTED BANDPASS FILTER (Hz) |
| 0 | 740 | 980 | FILTER1 (4300Hz) |
| 50 | 730 | 970 | FILTER1 (4300Hz) |
| 100 | 720 | 960 | FILTER1 (4300Hz) |
| 150 | 710 | 950 | FILTER1 (4300Hz) |
| 200 | 700 | 940 | FILTER1 (4300Hz) |
| 250 | 690 | 930 | FILTER1 (4300Hz) |
| 300 | 680 | 920 | FILTER1 (4300Hz) |

| TEMPERATURE 10 °C | | | |
|---|---|---|---|
| TOTAL OUTPUT PRINT PAGES (10^3 PAGES) | DISCHARGE START VOLTAGE Vth (V) | VOLTAGE AMPLITUDE AVAILABLE FOR OBTAINING TARGET DISCHARGE-CURRENT AMOUNT Vot (V) | SELECTED BANDPASS FILTER (Hz) |
| 0 | 720 | 950 | FILTER1 (4300Hz) |
| 50 | 710 | 940 | FILTER1 (4300Hz) |
| 100 | 700 | 930 | FILTER1 (4300Hz) |
| 150 | 690 | 920 | FILTER1 (4300Hz) |
| 200 | 680 | 910 | FILTER1 (4300Hz) |
| 250 | 670 | 900 | FILTER1 (4300Hz) |
| 300 | 660 | 890 | FILTER1 (4300Hz) |

| TEMPERATURE 20 °C | | | |
|---|---|---|---|
| TOTAL OUTPUT PRINT PAGES (10^3 PAGES) | DISCHARGE START VOLTAGE Vth (V) | VOLTAGE AMPLITUDE AVAILABLE FOR OBTAINING TARGET DISCHARGE-CURRENT AMOUNT Vot (V) | SELECTED BANDPASS FILTER (Hz) |
| 0 | 700 | 900 | FILTER2 (4500Hz) |
| 50 | 690 | 890 | FILTER2 (4500Hz) |
| 100 | 680 | 880 | FILTER2 (4500Hz) |
| 150 | 670 | 870 | FILTER2 (4500Hz) |
| 200 | 660 | 860 | FILTER2 (4500Hz) |
| 250 | 650 | 850 | FILTER2 (4500Hz) |
| 300 | 640 | 840 | FILTER2 (4500Hz) |

| TEMPERATURE 30 °C | | | |
|---|---|---|---|
| TOTAL OUTPUT PRINT PAGES (10^3 PAGES) | DISCHARGE START VOLTAGE Vth (V) | VOLTAGE AMPLITUDE AVAILABLE FOR OBTAINING TARGET DISCHARGE-CURRENT AMOUNT Vot (V) | SELECTED BANDPASS FILTER (Hz) |
| 0 | 680 | 800 | FILTER3 (5500Hz) |
| 50 | 670 | 790 | FILTER3 (5500Hz) |
| 100 | 660 | 780 | FILTER3 (5500Hz) |
| 150 | 650 | 770 | FILTER3 (5500Hz) |
| 200 | 640 | 760 | FILTER3 (5500Hz) |
| 250 | 630 | 750 | FILTER3 (5500Hz) |
| 300 | 620 | 740 | FILTER3 (5500Hz) |

IMAGE FORMING APPARATUS

BACKGROUND OF THE INVENTION

1. Field of the Invention

The present invention relates to an image forming apparatus using an electrophotographic process.

2. Description of the Related Art

Image forming apparatuses using an electrophotographic or electrostatic recording method have used a corona charger as a unit for charging an image-bearing member such as an electrophotographic photosensitive member or an electrostatic recording dielectric.

In recent years, a contact charger has been put into practice as the charge processing unit of an image-bearing member because of its advantages of low ozone production and low power consumption. The contact charger charges a charge target member in such a manner that a charging member to which a voltage is applied is brought into contact with the image-bearing member.

The charge method used for such a contact charger includes a "direct-current (DC) charge method" by which only a DC voltage is applied to a charging member to charge a charge target member. The charge method also includes an "alternating-current (AC) charge method" by which a charge target member is charged by applying an oscillation voltage that has an AC voltage component and a DC voltage component and whose voltage value periodically changes with time. In recent years, the "AC charge method" having good charge uniformity has been used widely.

When an image forming apparatus using such an AC charge method performs charge control, the image forming apparatus alternately applies positive and negative voltages and repeats discharge and back discharge. Accordingly, the discharge increases deterioration of a photoconductor drum that is a charged member on its surface. The deteriorated surface portion of the photoconductor drum is shaved due to friction with an abutting member such as a cleaning blade, and the life of the photo conductor is thus decreased.

Hence, many methods for controlling and minimizing a discharge current amount in the AC charge method have been proposed (for example, Japanese Patent Laid-Open No. 2010-231188).

An image forming apparatus proposed in Japanese Patent Laid-Open No. 2010-231188 uses a high-pass filter to extract a discharge current component from a current that flows between the photo conductor and the charger when an AC voltage is applied to the charger. Based on the extracted discharge current component, a peak-to-peak voltage value of the AC voltage is controlled.

SUMMARY OF THE INVENTION

As noted above, Japanese Patent Laid-Open No. 2010-231188 discloses controlling a peak-to-peak voltage value of AC voltage applied to a charger. However, studies by the inventors have proved that, in a case where an environmental factor such as the temperature or the humidity is changed, a discharge start voltage is changed, and the frequency of the discharge current component is thus changed. In a case where the frequency of the discharge current component is changed as described above, the method in which the frequency band of a filter for extracting the discharge current component as described in Japanese Patent Laid-Open No. 2010-231188 does not enable highly accurate detection of a discharge current amount.

The present invention provides an image forming apparatus that enables an AC voltage applied to a charging member to be controlled with high accuracy even in a case where an environmental factor is changed.

According to an aspect of the present invention, an image forming apparatus includes an image-bearing member, a charging member configured to charge the image-bearing member by receiving a charge voltage in which a direct-current voltage and an alternating-current voltage are superposed on each other, a power source configured to apply a voltage to the charging member, a toner-image forming unit configured to form a toner image on the image-bearing member charged by the charging member, a detector configured to detect a current flowing through the charging member when the power source applies the charge voltage to the charging member, an extraction unit configured to extract, from the current detected by the detector when the charge voltage is applied to the charging member, a current in a frequency band including a discharge current component, an adjustment unit configured to adjust the alternating-current voltage based on the current extracted by the extraction unit, an acquisition unit configured to acquire environmental information, and a setting unit configured to set, based on the environmental information acquired by the acquisition unit, a frequency band for extraction performed by the extraction unit.

Further features of the present invention will become apparent from the following description of exemplary embodiments (with reference to the attached drawings).

BRIEF DESCRIPTION OF THE DRAWINGS

FIG. 8 illustrates an example of frequency band control tables for setting the frequency band of an extraction unit.

FIG. 9 illustrates an example of frequency band control tables for setting the frequency band of the extraction unit.

FIG. 10 illustrates an example of frequency band control tables for setting the frequency band of the extraction unit.

FIG. 12 illustrates an example of frequency band control tables for setting the frequency band of the extraction unit.

FIG. 15 illustrates an example of frequency band control tables for selecting the frequency band of the extraction unit.

DESCRIPTION OF THE EMBODIMENTS

Figure 1:
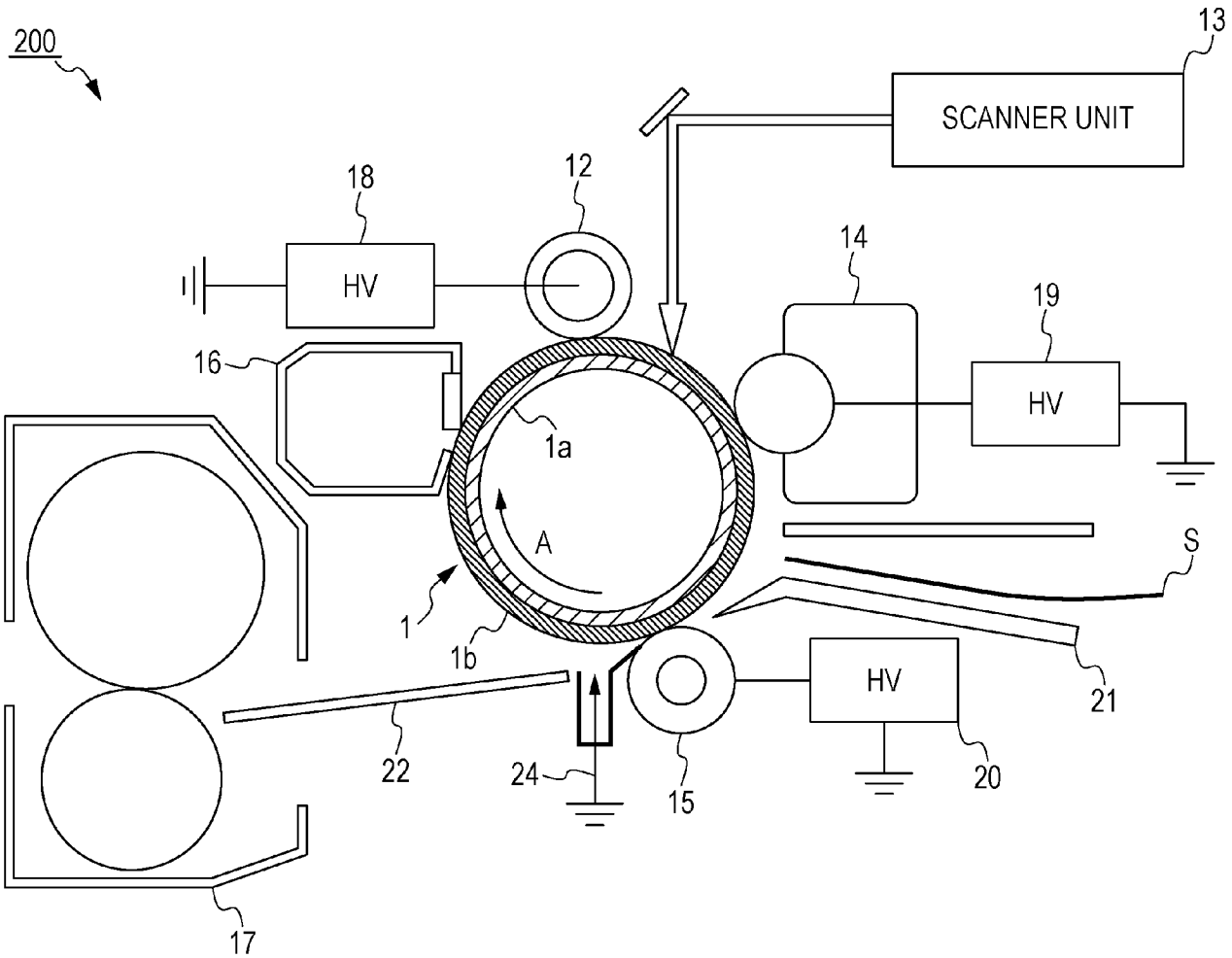
FIG. 1 is a diagram illustrating a schematic configuration of an image forming apparatus according to an embodiment of the invention.

Hereinafter, embodiments of the invention will be described in detail with reference to the drawings. Components denoted by the same reference numerals in the respective drawings have the same configuration or act in the same manner, and repeated description thereof is omitted as appropriate. Note that the dimensions, the material, the shape, the relative position, and the like of each component are not intended to limit the applicable scope of the technical idea to only these unless otherwise particularly stated.

First Embodiment

FIG. 1 is a diagram illustrating a schematic configuration of an image forming apparatus 200 according to a first embodiment of the invention.

In FIG. 1, a photoconductor drum 1 is an image-bearing member that is a charge target member, and the photoconductor drum 1 has an electro-conductive support member 1*a* and a photoconductive layer 1*b* formed on the electro-conductive support member 1*a*. The image forming apparatus 200 further includes a charge roller 12 that is a charging member, a developing device 14 that is a developing unit, a transfer roller 15 that is a transfer unit, a cleaner 16 that is a cleaning unit, and the like that are disposed around the photoconductor drum 1 and listed in a direction of an arrow A in which the photoconductor drum 1 rotates. In addition, a scanner unit 13 is disposed above the photoconductor drum 1. The charge roller 12 is brought into pressure contact with the photoconductor drum 1 by using a spring (not illustrated), and the photoconductor drum 1 is thereby charged.

A charge power source 18 corresponds to an application unit that applies a charge voltage for charging the photoconductor drum 1 to the charge roller 12. The charge power source 18 applies an AC voltage as the charge voltage on which a DC voltage is superposed to the charge roller 12. A development power source 19 supplies a development bias to a developing sleeve 14*a* of the developing device 14. A transfer power source 20 supplies a transfer bias to the transfer roller 15. The image forming apparatus 200 is also provided with a discharging needle 24, transportation guides 21 and 22, and a fixing device 17 serving as a fixing unit.

An image forming operation of the image forming apparatus 200 will next be described.

When the image forming operation is started, the photoconductor drum 1 is first driven by a drive unit (not illustrated) to rotate in the direction of the arrow A at a process speed of 200 mm/sec. Discharge occurs toward the photoconductor drum 1 from the charge roller 12 to which a charge voltage is applied, and the photoconductor drum 1 is thereby charged evenly at a predetermined polarity and a predetermined electric potential.

In the photoconductor drum 1 having the surface charged by the charge roller 12, the surface is subsequently exposed to laser L emitted from the scanner unit 13 serving as an exposure unit, the laser L being emitted in accordance with image information such as characters and figures transmitted from an external information apparatus such as a personal computer. A portion, of a photo conductor, irradiated with the laser L, undergoes charge removal and has a bright-section potential (VL) having a small electric potential. As the result, an electrostatic latent image is formed on the surface of the photoconductor drum 1.

The electrostatic latent image undergoes toner development performed by the developing device 14 serving as the developing unit, and a toner image is formed on the surface of the photoconductor drum 1. A superposed voltage (development voltage) of the AC voltage and the DC voltage is supplied from the development power source 19 to the developing sleeve 14*a* of the developing device 14 and causes a potential difference between the developing sleeve 14*a* and the electrostatic latent image on the photoconductor drum 1. The potential difference causes the toner to be transferred to the electrostatic latent image and thereby causes the toner image to be formed on the photoconductor drum 1. The scanner unit 13 and the developing device 14 correspond to a toner image forming unit.

Meanwhile, recording sheets S that are recording media have been stored in a paper cassette (not illustrated). In parallel with the toner image forming operation, one of the recording sheets S is transported to a nip between the photoconductor drum 1 and the transfer roller 15 at a predetermined timing. A transfer bias applied to the transfer roller 15 causes the toner image on the photoconductor drum 1 to be transferred onto the recording sheet S at a predetermined position.

The recording sheet S bearing a transferred unfixed toner image on its surface is separated from the photoconductor drum 1 by using the grounded discharging needle 24 and is introduced into the fixing device 17 serving as a fixing unit by using the transportation guide 22. The transfer medium S subsequently undergoes pressure heating in the fixing device 17, the unfixed toner image thereby becomes a permanent image, and the recording sheet S having the toner image permanently fixed thereon is ejected to the outside.

The cleaner 16 removes, from the photoconductor drum 1 from which the toner image is transferred, the toner remaining on the surface without being transferred to the recording sheet S, and the photoconductor drum 1 is ready for the next image forming. Repeating the operations described above enables the image forming one after another.

Figure 2:
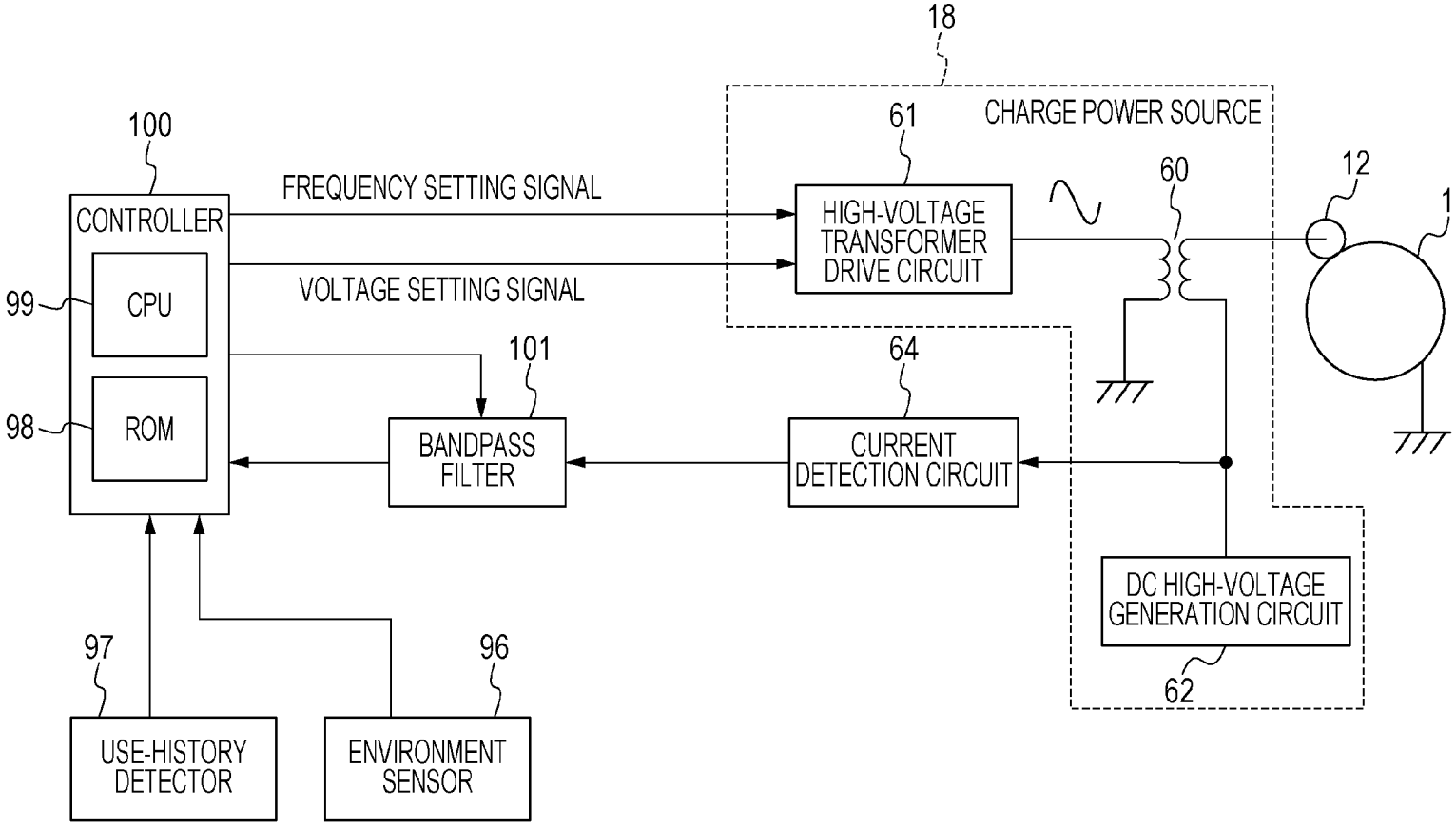
FIG. 2 is a diagram illustrating a schematic configuration of a control circuit that controls a discharge current amount of the image forming apparatus.

FIG. 2 is a diagram illustrating a schematic configuration of a control circuit 300 that controls a discharge current amount of the image forming apparatus 200 in FIG. 1.

In FIG. 2, a high-voltage transformer drive circuit 61 generates a sinusoidal wave on the basis of a frequency setting signal and a voltage setting signal that are input by a controller 100 including a central processing unit (CPU) 99 and a read-only memory (ROM) 98 that has control data stored therein. The frequency of the sinusoidal wave in the embodiment is 2000 Hz. In the control data in the ROM 98, use amount information of the photoconductor drum 1 and environmental information are stored. The use amount information includes the total number of pages (the total number of print pages) acquired by a use-history detector 97 serving as a use-amount acquisition unit (use-history detector), the pages having undergone image forming performed by the image forming apparatus 200. The use amount information also includes a rotation time of the photoconductor drum 1, a voltage application time in which the charge power source 18 applies a voltage to the charge roller 12, and other information. The environmental information includes temperature, relative humidity, absolute humidity, and the like that are detected by an environment sensor 96 serving as an acquisition unit (environment detector). The voltage of the sinusoidal wave generated by the high-voltage transformer drive circuit 61 is increased by a high-voltage transformer 60.

A DC high-voltage generation circuit 62 generates a DC high voltage. The generated DC voltage and the AC high voltage that has been increased by the high-voltage transformer 60 are superposed on each other and are applied to the charge roller 12.

A current detection circuit 64 corresponds to a detector (current detector) that detects a current flowing through the charge roller 12 to which the AC voltage is applied by the charge power source 18. The current detection circuit 64 detects, by using a full-wave rectification, the current caused to flow through the charge roller 12 by the voltage applied from the high-voltage transformer drive circuit 61 and the DC high-voltage generation circuit 62. A bandpass filter 101 corresponds to an extraction unit that extracts a current component in a predetermined frequency band including a discharge current component of a current waveform detected by the current detector. The bandpass filter 101 may be an analog signal circuit or a digital signal circuit. In the embodiment, analog-to-digital (A/D) conversion is performed by using a sampling frequency of 44,100 Hz on the current waveform detected by the current detection circuit 64, and a discharge current component is thereafter extracted in digital signal processing. A digital signal processing circuit for removing current components other than the discharge current component is configured by using an application specific integrated circuit (ASIC). Note that a field programmable gate array (FPGA) may also be used, and a high-general-purpose digital signal possessor (DSP) may be operated in accordance with a program.

The setting of the frequency band for the bandpass filter 101 performed by the controller 100 serving as a setting unit is determined by using one of frequency band control tables stored in the ROM 98, on the basis of the use amount information received from the use-history detector 97 and the environmental information received from the environment sensor 96. Specifically, a median value of the frequency band is set. In the embodiment, control is performed by using the setting based on information regarding the total number of output print pages and temperature information as the use amount information and the environmental information, respectively. An output signal in the predetermined frequency band extracted by the bandpass filter 101 is input to the controller 100.

Figure 3:
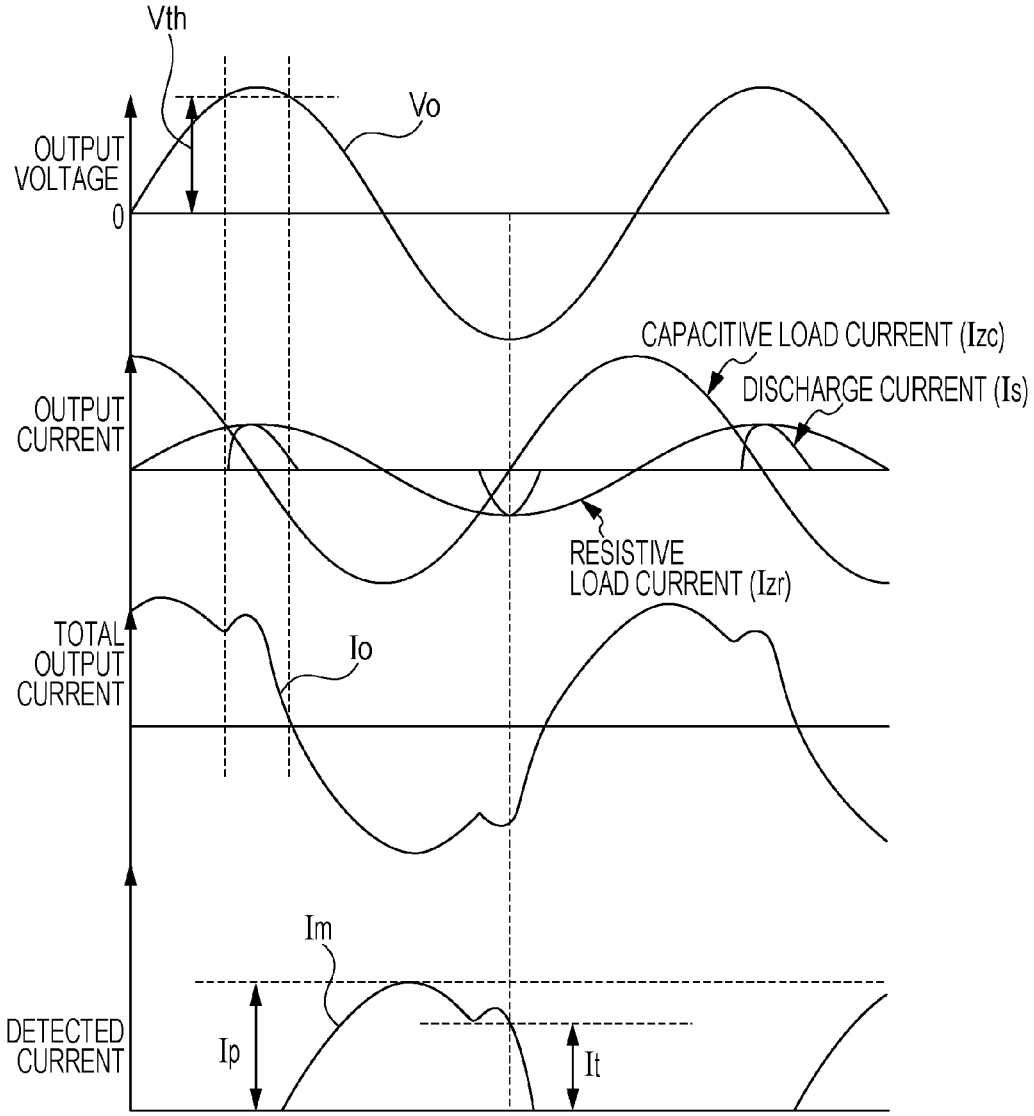
FIG. 3 is a graph illustrating waveforms of currents and a voltage of a charge voltage applied to a charge roller.

FIG. 3 is a graph illustrating waveforms of currents and an AC voltage applied to the charge roller 12 by the charge power source 18 in FIG. 1. In FIG. 3, the vertical axis represents voltage and current, and the horizontal axis is a temporal axis.

When an AC voltage (Vo) illustrated in FIG. 3 is applied to the charge roller 12, a resistive load current (Izr) having the same phase as that of the AC voltage (Vo) flows to a resistive load between the charge roller 12 and the photoconductor drum 1.

In addition, a capacitive load current (Izc) having a phase advanced by 90 degrees from the AC voltage (Vo) flows to a capacitive load between the charge roller 12 and the photoconductor drum 1. Further, while the amplitude of the AC voltage is being equal to or higher than that of a discharge start voltage (Vth) in the configuration described above, discharge occurs between the charge roller 12 and the photoconductor drum 1 and causes a flow of a pulse discharge current (Is). The discharge occurs in a gap portion adjacent to a nip portion between the charge roller 12 and the photoconductor drum 1. Accordingly, in a case where the discharge start voltage (Vth) varies depending on the use amount information of an apparatus or the installation environment, the frequency of the discharge current (Is) also varies.

As a total current of the resistive load current (Izr), the capacitive load current (Izc), and the discharge current (Is), a current Io flows. A detected current waveform Im represents a waveform observed when an alternating current drawn from a charge roller to a high-voltage power source is detected.

Based on these relationships and by using the amplitude of the AC bias voltage (Vo), the frequency of the AC bias voltage (Vo), and the discharge start voltage (Vth) in the configuration described above, setting of the frequency of the bandpass filter 101 using a discharge current (Is) section as a passband is in advance calculated based on experiments and is stored in the frequency band control tables in the ROM 98.

Figure 4:
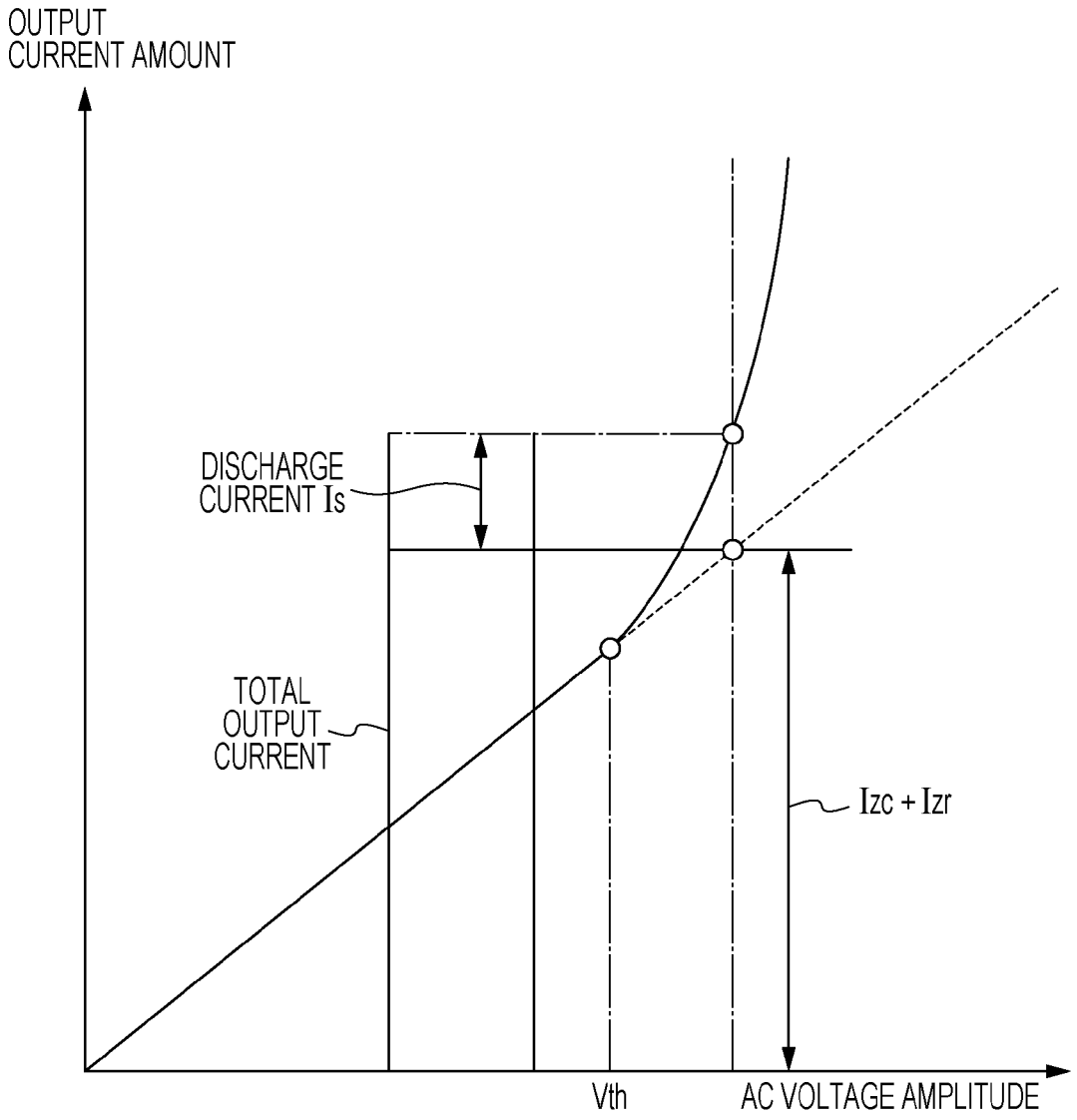
FIG. 4 is a graph illustrating a relationship between an AC voltage amplitude and an output current amount.

FIG. 4 is a graph illustrating a relationship between the amplitude of the AC voltage applied to the charge roller 12 and an amount of an output current that is an alternating current flowing to the charge roller 12 at that time. In FIG. 4, the vertical axis represents output current amount, and the horizontal axis represents AC voltage amplitude.

In FIG. 4, while being equal to or lower than the amplitude of the discharge start voltage (Vth) at which discharge is started between the charge roller 12 and the photoconductor drum 1, the AC voltage amplitude is almost proportional to the output current amount. While the AC voltage amplitude is equal to or lower than the discharge start voltage (Vth), the resistive load current (Izr) and the capacitive load current (Izc) are proportional to the AC voltage amplitude, and the AC voltage amplitude is small. Accordingly, discharge does not occur, and the discharge current (Is) does not flow.

In contrast, when the AC voltage amplitude is gradually increased, the discharge is started at the predetermined amplitude of the AC voltage (Vth). Accordingly, the AC voltage amplitude is not proportional to the total output current (Io), and the output current flow is increased by an amount of the discharge current (Is).

Figure 5:
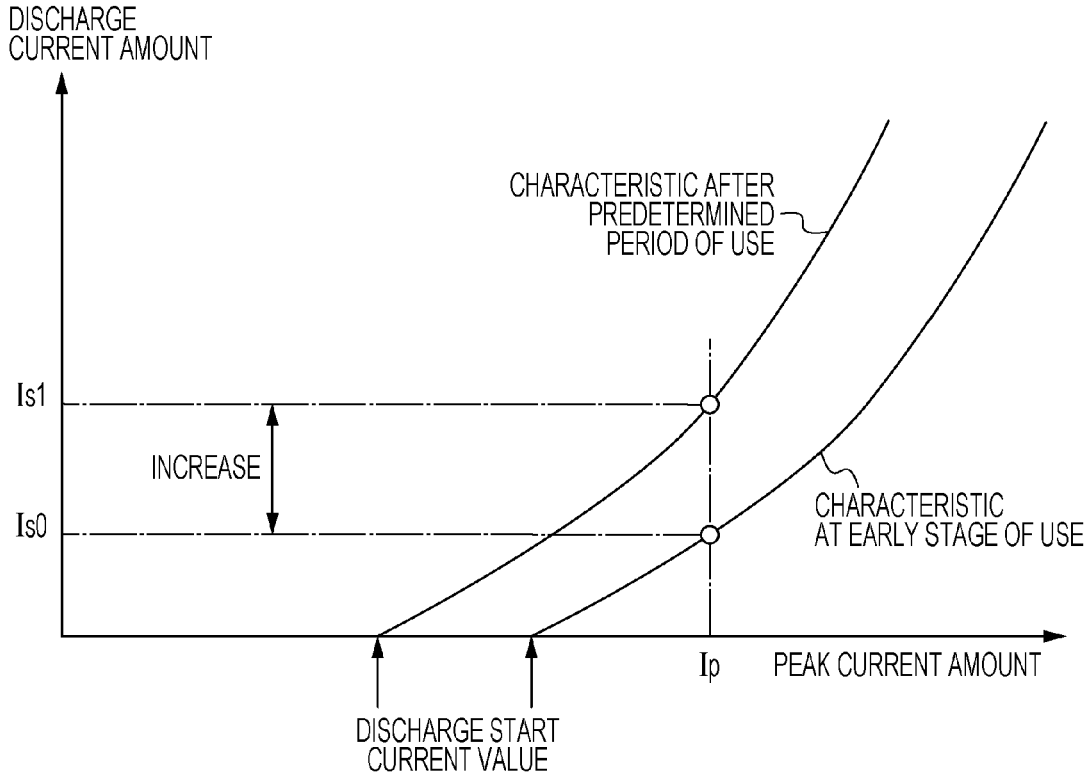
FIG. 5 is a graph illustrating a relationship between a peak current amount Ip of a total output current applied to the charge roller and a discharge current amount.

FIG. 5 is a graph illustrating a relationship between a peak current amount Ip of a total output current to be applied to the charge roller 12 and a discharge current amount. In FIG. 5, the vertical axis represents discharge current amount, and the horizontal axis represents peak current amount.

In FIG. 5, when a characteristic at the early stage of using the charge roller 12 is compared with a characteristic after a predetermined period of use, the charge roller 12 after the predetermined period of use has a low value of a discharge start current that starts flowing at the time of discharge. This is because impedance is changed due to a build-up of toner, a change in film thickness of the photoconductor drum 1, and the like. In addition, the discharge current amount in a peak current amount (Ip) is increased from Is0 to Is1.

Figure 6:
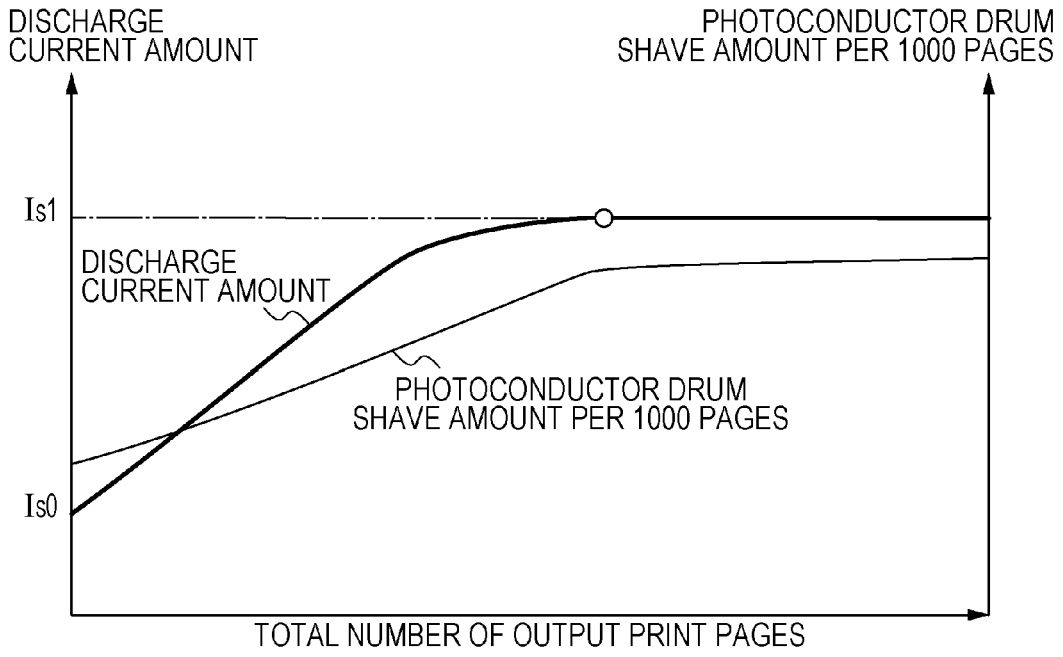
FIG. 6 is a graph illustrating a relationship between a discharge current amount and the total number of output print pages.

FIG. 6 is a graph illustrating a relationship between a discharge current amount and the total number of output print pages. In FIG. 6, the vertical axis represents discharge current amount and photoconductor-drum shave amount per 1000 pages, and the horizontal axis represents the total number of output print pages.

When control is performed to keep the peak current amount (Ip) constant, an increase in the total number of output print pages leads to an increase in the discharge current amount from the discharge current amount Is0 at the early stage of use to the discharge current amount Is1, as illustrated in FIG. 6.

The amount of shaving of the surface of the photoconductor drum 1 that leads to deterioration of the photoconductor drum 1 is increased in proportion to the discharge current amount.

Accordingly, in the constant current control as in the related art, as the total number of output print pages is increased, the photoconductor drum 1 is shaved at an accelerated pace, and the life of the photoconductor drum 1 is thus decreased. Hence, a discharge current component is directly controlled in the embodiment in order to control the amount of shaving of the photoconductor drum 1.

Figure 7:
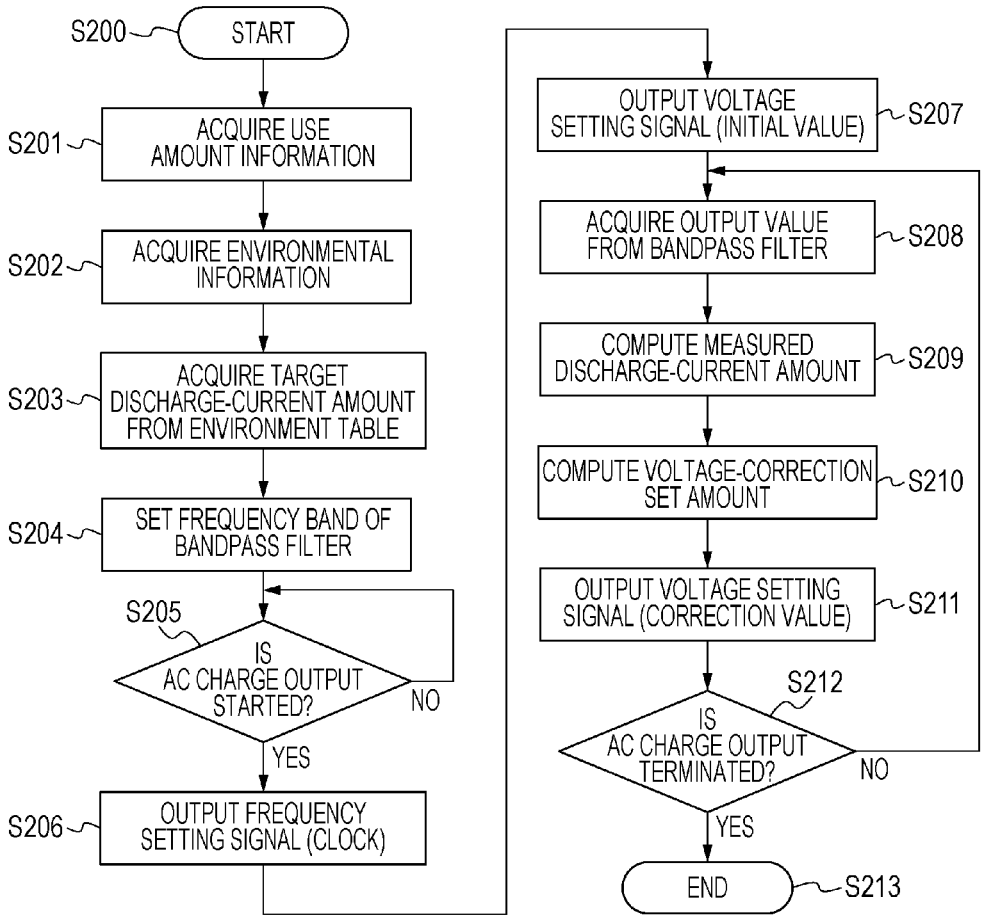
FIG. 7 is a flowchart illustrating steps of a discharge current control process performed by a controller.

FIG. 7 is a flowchart illustrating steps of a discharge current control process performed by the controller 100 in FIG. 2.

In FIG. 7, an image forming operation and an adjusting operation are started (step S200). When the use-history detector 97 and the environment sensor 96 serving as the acquisition unit (environment detector) detect the use amount information and the environmental information (steps S201 and S202), the controller 100 acquires a target discharge-current amount associated with the environmental information from an environment table stored in the ROM 98 (step S203). The environment table has target discharge-current amounts each for achieving appropriate charge in accordance with the state of the image forming apparatus 200. Also in the embodiment, the information regarding the total number of output print pages and the temperature information are used as the use amount information and the environmental information, respectively. Also in the embodiment, the information regarding the total number of output print pages is acquired by a counter serving as the use-amount acquisition unit. The controller 100 sets the frequency band of a bandpass filter by using one of the frequency band control tables in FIG. 8 that are stored in the ROM 98 on the basis of the discharge start voltage (Vth) and the amplitude (Vot) of the applied voltage waveform, the discharge start voltage (Vth) varying with the use amount information, the amplitude (Vot) being available for obtaining a target discharge-current amount (step S204). The discharge start voltage (Vth) and the amplitude (Vot) have been calculated in advance based on experiments.

If output of the AC voltage as the charge voltage is started (YES in step S205), the controller 100 outputs, to the high-voltage transformer drive circuit 61, a frequency setting signal (clock) for setting the frequency of the AC voltage (step S206).

Further, the controller 100 outputs a voltage setting signal (initial value) for setting the amplitude of the AC voltage (step S207). The voltage setting signal (initial value) used here has been stored in advance.

Meanwhile, a charging operation has been started when the charge voltage is applied to the charge roller 12 on the basis of the voltage setting signal (initial value), and a detected current waveform has been obtained by the current detection circuit 64 in the charge power source 18.

The waveform signal undergoes the A/D conversion performed using the sampling frequency of 44,100 Hz and is input to the controller 100 through the bandpass filter 101 in the determined frequency band.

The CPU 99 acquires an output value from the bandpass filter 101 (step S208).

The CPU 99 computes a measured discharge-current amount H (measured amount) on the basis of the acquired output value (step S209).

The measured discharge-current amount H is subsequently compared with the target discharge-current amount, and a voltage-correction set amount that is an amount of correction to the voltage setting signal is computed so that the difference between the measured discharge-current amount H and the target discharge-current amount can be decreased (step S210). The voltage setting signal (correction value) having undergone the correction is output to the high-voltage transformer drive circuit 61 (step S211). Step S211 corresponds to an operation of an adjustment unit that performs adjustment on an AC voltage applied by the charge power source 18, the adjustment being performed using the measured amount determined from the output value of the bandpass filter and a reference amount predetermined to control an amount of the discharge current flowing from the charge roller 12 to the photoconductor drum 1.

The successive correction made to the voltage setting signal is continued at fixed sampling intervals until application of the AC voltage as the charge voltage is terminated (YES in step S212), and the AC voltage output is terminated (step S213).

With the processing described above, more accurate discharge-current-amount control can be performed any time and in real time in the embodiment.

In the embodiment described above, the frequency band of a bandpass filter is changed depending on the apparatus-use amount information and the installation environment, and the discharge current section in the detected current waveform can thereby be extracted more accurately. A discharge current component can thus be directly estimated with high accuracy, while preventing extraction of a high-frequency component such as noise of the high-voltage power source. Accordingly, even in a case where the environment factor is changed, highly accurate detection of the discharge current component enables an AC voltage applied to a charging member to be controlled with higher accuracy. Also in the embodiment, control based on the use amount information of the photo conductor is performed. Even in a case where the film thickness of the photo conductor is changed, the AC voltage applied to the charging member can be controlled with higher accuracy. In addition, the discharge-current-amount control can be performed in real time. Accordingly, a uniform charge state can be maintained in continuous image formation, and print in high quality and high image quality can be output stably for a long period.

Second Embodiment

In the first embodiment, the example in which the temperature information acquired from the environment sensor and the information regarding the total number of output print pages are used as the environmental information and the use amount information, respectively, has been described. In a second embodiment, an example in which information regarding a total rotation time of the photoconductor drum 1 and relative humidity information are used as the use amount information and the environmental information, respectively, will be described.

Note that the same components as those in the first embodiment are denoted by the same reference numerals, and repeated explanation is omitted as appropriate.

FIG. 9 illustrates frequency band control tables used to set the frequency band of the bandpass filter 101 serving as the extraction unit on the basis of the photo-conductor rotation time information and the relative humidity information. Relationships between a total rotation time of the photoconductor drum 1 obtained in advance based on experiments and the frequency band of the bandpass filter 101 are stored, in the ROM 98, as tables respectively provided for relative humidity values. Each table illustrated in FIG. 9 also contains the discharge start voltage (Vth) and the amplitude (Vot) of the AC voltage applied to the charge roller 12 and available for obtaining a target discharge-current amount. The frequency band of the bandpass filter 101 is set by performing computation on the basis of the information. The frequency band of the bandpass filter 101 is set by the controller 100.

The embodiment is applicable to such cases where the photoconductor drum 1 has been relatively largely shaved and rotating operations of the photoconductor drum 1 themselves accelerates the shaving and where a value of resistance of the charge roller 12 varies with the relative humidity.

In addition, performing the control in the same manner as in the foregoing first embodiment provides the same effects as in the first embodiment.

In the embodiment as described above, the discharge current amount that changes depending on the total rotation time of the photoconductor drum and the relative humidity is detected with higher accuracy, and the AC voltage applied to the charging member can thereby be controlled with higher accuracy.

Third Embodiment

In the second embodiment, the example in which the relative humidity information acquired from the environment sensor and the photo-conductor rotation time information are used as the environmental information and the use amount information, respectively, has been described. In a third embodiment, absolute humidity information acquired from the environment sensor and information regarding a total application time in which the AC voltage is applied from the charge power source 18 to the charge roller 12 are used as the environmental information and the use amount information, respectively.

Note that the same components as those in the first embodiment are denoted by the same reference numerals, and repeated explanation is omitted as appropriate.

FIG. 10 illustrates frequency band control tables used to set the frequency band of the bandpass filter 101 serving as the extraction unit on the basis of the information regarding the total application time in which the AC voltage is applied and the absolute humidity information. Relationships between the total application time in which the AC voltage is applied and the frequency band of the bandpass filter 101 are stored, in the ROM 98, as tables respectively provided for absolute humidity values. The total application time has obtained in advance based on experiments. Each table illustrated in FIG. 10 also contains the discharge start voltage (Vth) and the amplitude (Vot) of the AC voltage applied to the charge roller 12 and available for obtaining a target discharge-current amount. The frequency band of the bandpass filter 101 is set by performing computation on the basis of the information. The frequency band of the bandpass filter 101 is set by the controller 100.

The embodiment is applicable to such cases where the discharge exerted from the charge roller to the photoconductor drum notably accelerates an increase in the amount of shaving of the photoconductor drum 1 and where a value of resistance of the charge roller 12 varies with the absolute humidity.

In addition, performing the control in the same manner as in the foregoing first embodiment provides the same effects as in the first embodiment.

In the embodiment as described above, the discharge current amount that changes depending on the absolute humidity and the total application time in which the AC voltage is applied from the charge power source to the charge roller is detected with higher accuracy, and the AC voltage applied to the charging member can thereby be controlled with higher accuracy.

Fourth Embodiment

In the third embodiment, the example has been described in which the absolute humidity information acquired from the environment sensor and the information regarding the total application time in which the AC voltage is applied from the charge power source 18 to the charge roller 12 are used as the environmental information and the use amount information, respectively. In a fourth embodiment, the absolute humidity information acquired from the environment sensor is used as the environmental information. In addition, information regarding combined impedance of the photoconductor drum 1 and the charge roller 12 is used as the use amount information.

Note that the same components as those in the first embodiment are denoted by the same reference numerals, and repeated explanation is omitted as appropriate.

Figure 11:
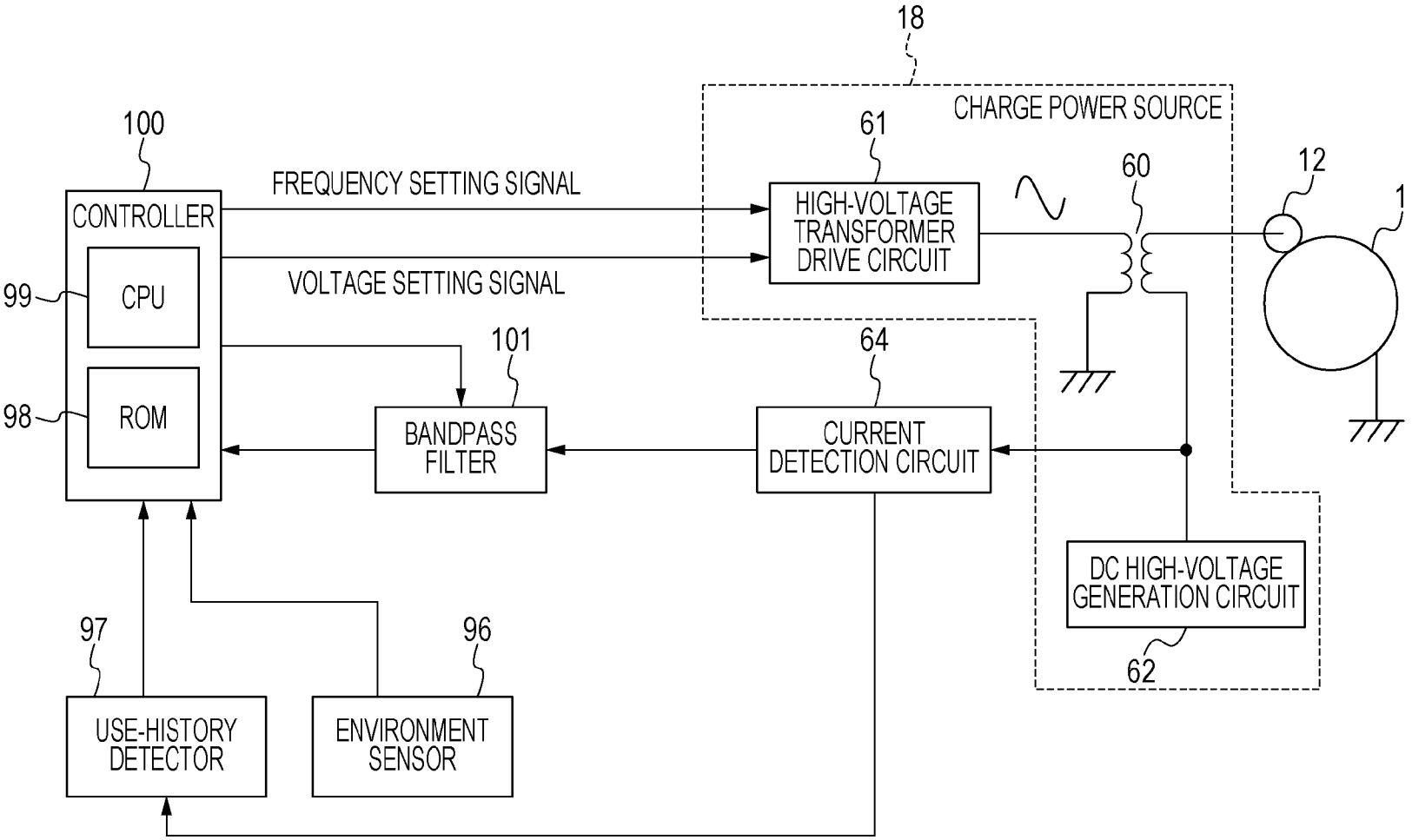
FIG. 11 is a diagram illustrating a schematic configuration of a control circuit that controls a discharge current amount of the image forming apparatus.

FIG. 11 is a diagram illustrating a schematic configuration of a control circuit 300 that controls a discharge current amount of the image forming apparatus 200 in the embodiment.

In the configuration, the use-history detector 97 serving as the use-amount acquisition unit corresponds to an impedance calculation unit that calculates combined impedance of the photoconductor drum 1 and the charge roller 12. The impedance calculation unit calculates the impedance on the basis of a charge voltage applied by the charge power source 18 and a value of a current detected by the current detection circuit 64, the current flowing to the charge roller 12 at the time of application of the charge voltage.

When the controller 100 sets the frequency band of the bandpass filter 101, control is performed by using the impedance information and the absolute humidity information as the use amount information and the environmental information, respectively. In other words, the use-history detector 97 serving as the use-amount acquisition unit acquires a result of detection performed by the current detection circuit 64 serving as a detector, and the controller 100 sets the frequency band of the bandpass filter on the basis of the acquired detection result and the environmental information.

In the embodiment, the voltage applied by the charge power source 18 at the time of calculating the impedance is an AC voltage having a peak-to-peak voltage of 1800V.

FIG. 12 illustrates frequency band control tables used to set the frequency band of the bandpass filter 101 serving as the extraction unit on the basis of an effective value of the alternating current detected by the current detection circuit 64 and the absolute humidity information. Relationships between the effective value obtained in advance based on experiments and the frequency band of the bandpass filter 101 are stored, in the ROM 98, as tables respectively provided for absolute humidity values. Each table illustrated in FIG. 12 also contains the impedance calculated based on the applied voltage and the effective value of the alternating current detected by the current detection circuit 64, the discharge start voltage (Vth), and the amplitude (Vot) of the AC voltage applied to the charge roller 12 and available for obtaining a target discharge-current amount. The frequency band of the bandpass filter 101 is set by performing computation on the basis of the information. The frequency band of the bandpass filter 101 is set by the controller 100.

In the embodiment, the amount of shaving of the photoconductor drum 1 having a largest influence on the discharge start voltage and the resistance of the charge roller can be estimated directly from the impedance information, and the frequency band of the bandpass filter can thus be set with higher accuracy.

In addition, performing the control in the same manner as in the foregoing first embodiment provides the same effects as in the first embodiment.

In the embodiment as described above, the discharge current amount that changes depending on the absolute humidity and the information regarding the combined impedance of the photoconductor drum and the charge roller is detected with higher accuracy, and the AC voltage applied to the charging member can thereby be controlled with higher accuracy.

Fifth Embodiment

Hereinafter, another embodiment of the invention will be described with reference to the drawings.

Note that the same components as those in the first embodiment are denoted by the same reference numerals, and repeated explanation is omitted as appropriate.

Figure 13:
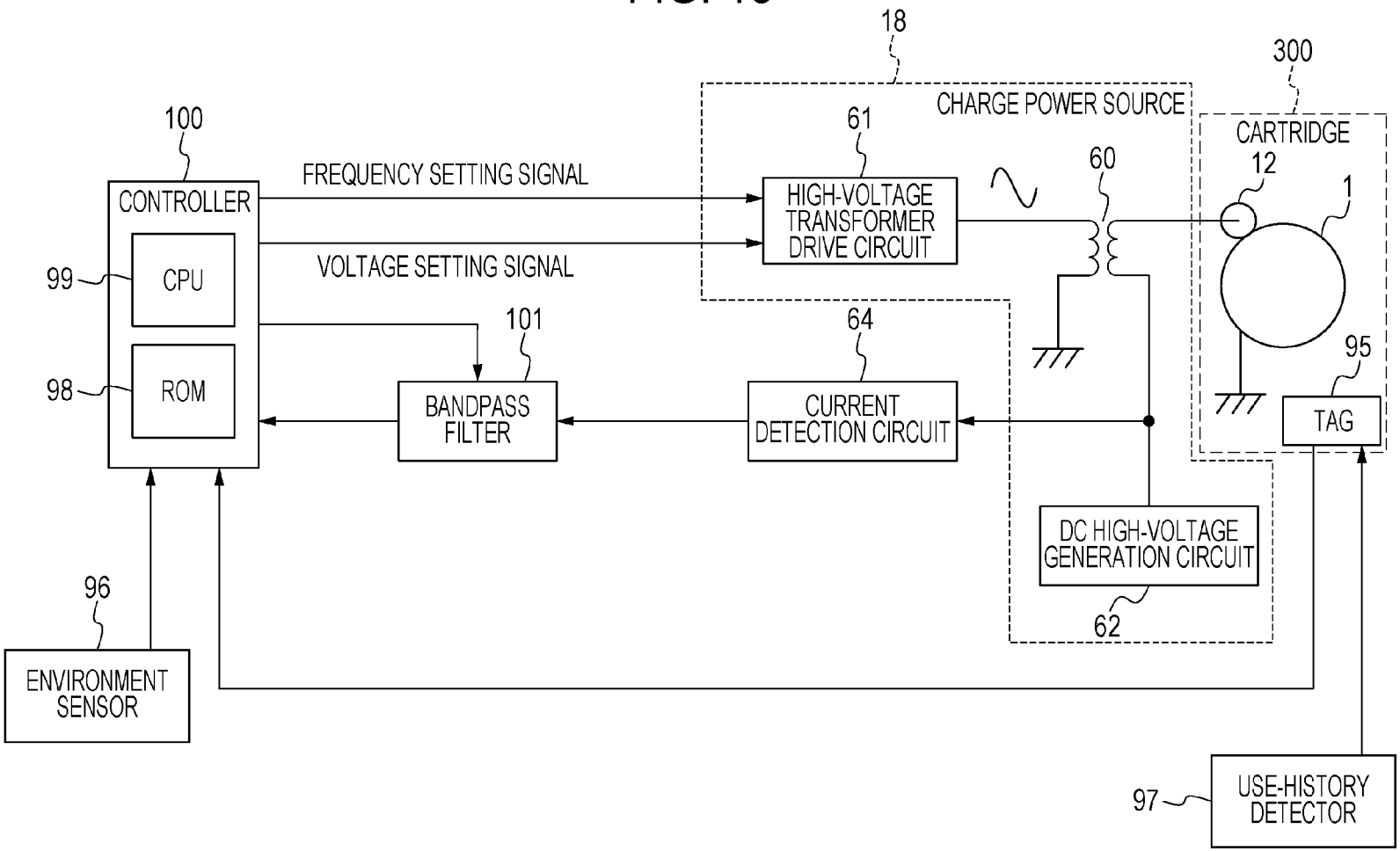
FIG. 13 is a diagram illustrating a schematic configuration of a control circuit that controls a discharge current amount of the image forming apparatus.

FIG. 13 is a diagram illustrating a schematic configuration of a control circuit 300 that controls a discharge current amount of the image forming apparatus 200 in FIG. 1.

In the embodiment as illustrated in FIG. 13, there is provided a replaceable cartridge 300 including the photoconductor drum 1, the charge roller 12, and a contact tag 95 that are integrated into the cartridge 300. The tag 95 is provided for storing the use amount information received from the use-history detector 97. When the cartridge 300 is attached to the image forming apparatus 200, the controller 100 stores, in the control data in the ROM 98, the total number of output print pages of the image forming apparatus 200, the rotation time of the photoconductor drum 1, and the voltage application time in which the charge power source 18 applies a voltage to the charge roller 12 that are read from the tag 95. The controller 100 also stores the temperature, the relative humidity, and the absolute humidity that are detected by the environment sensor 96.

In the embodiment, the setting of the frequency band for the bandpass filter 101 performed by the controller 100 is determined by using one of the frequency band control tables in FIG. 10 stored in the ROM 98, on the basis of the information regarding the total application time in which the AC voltage is applied from the charge power source 18 to the charge roller 12 and the absolute humidity information received from the environment sensor 96.

In the embodiment as described above, in the image forming apparatus having the configuration using the cartridge, the use conditions of the cartridge are stored in the tag. Even before or after replacement of the cartridge, the discharge current amount is detected with higher accuracy, and the AC voltage applied to the charging member can thereby be controlled with higher accuracy.

Sixth Embodiment

Hereinafter, another embodiment of the invention will be described in detail with reference to the drawings.

Note that the same components as those in the first embodiment are denoted by the same reference numerals, and repeated explanation is omitted as appropriate.

Figure 14:
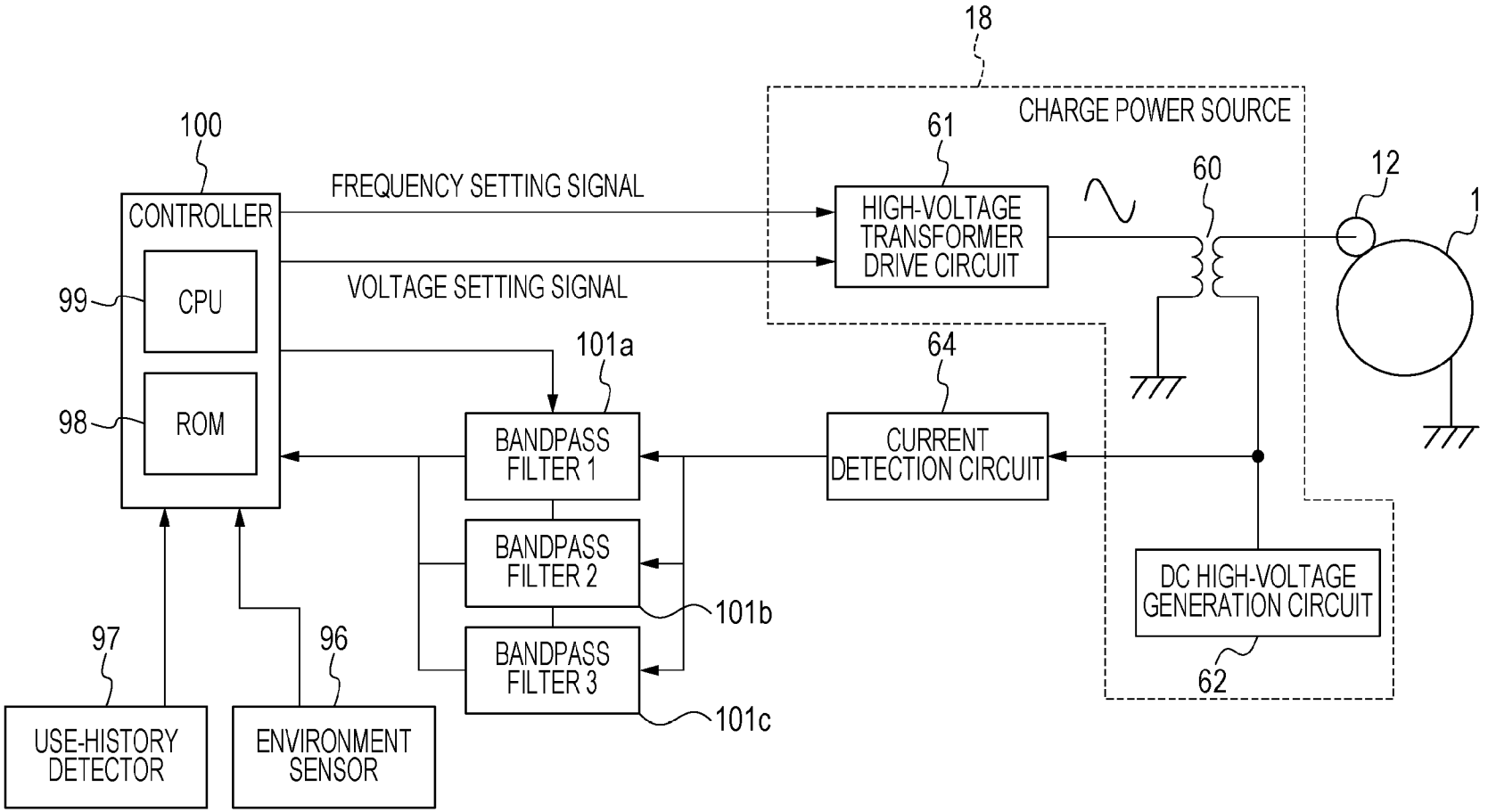
FIG. 14 is a diagram illustrating a schematic configuration of a control circuit that controls a discharge current amount of the image forming apparatus.

FIG. 14 is a diagram illustrating a schematic configuration of a control circuit 300 that controls a discharge current amount of the image forming apparatus 200 in FIG. 1.

The bandpass filter 101 in a sixth embodiment corresponds to the extraction unit that extracts a current component in a predetermined frequency band of a current waveform detected by the current detector and extracts the discharge current component in such a manner as to select one of a plurality of analog signal circuits set to respectively different frequency bands.

The controller 100 selects one of bandpass filters 101*a*, 101*b*, and 101*c* set to respectively different frequency bands, by using frequency band control tables stored in the ROM 98, on the basis of use amount information acquired from the use-history detector 97 serving as a use-amount acquisition unit and detector and the environmental information acquired from the environment sensor 96. The controller 100 selects one of the bandpass filters 101*a*, 101*b*, and 101*c* that has a frequency band associated with the use amount information and the environmental information that are closest to the acquired information. In the embodiment, control is performed by using the information regarding the total number of output print pages and the temperature information as the use amount information and the environmental information, respectively. An output signal in the predetermined frequency band extracted by the selected bandpass filter 101 is input to the controller 100.

FIG. 15 illustrates the frequency band control tables from which the frequency band of the bandpass filter 101 is selected on the basis of the discharge start voltage (Vth) and the amplitude (Vot) of the applied voltage waveform, the discharge start voltage (Vth) varying depending on the total number of output print pages of the image forming apparatus, the total number being calculated in advance based on experiments, the amplitude (Vot) being available for obtaining the target discharge-current amount determined based on the temperature information. The frequency band control tables are stored in the ROM 98, and the controller 100 selects one of the bandpass filters 101*a*, 101*b*, and 101*c*.

The embodiment is applicable to a case where changing the frequency band of the bandpass filter is difficult, such as a case where an analog signal circuit is used as the extraction unit that extracts a current component in a predetermined frequency band.

In addition, performing the control in the same manner as in the foregoing first embodiment provides the same effects as in the first embodiment.

Seventh Embodiment

In each of the first to sixth embodiments, the example in which one bandpass filter 101 extracts the discharge current component has been described.

In a seventh embodiment, an example in which an AC voltage applied to the charging member is controlled based on a plurality of discharge current components extracted from the plurality of bandpass filters in respective different frequency bands will be described.

Note that the same components as those in the first embodiment are denoted by the same reference numerals, and repeated explanation is omitted as appropriate.

Figure 16:
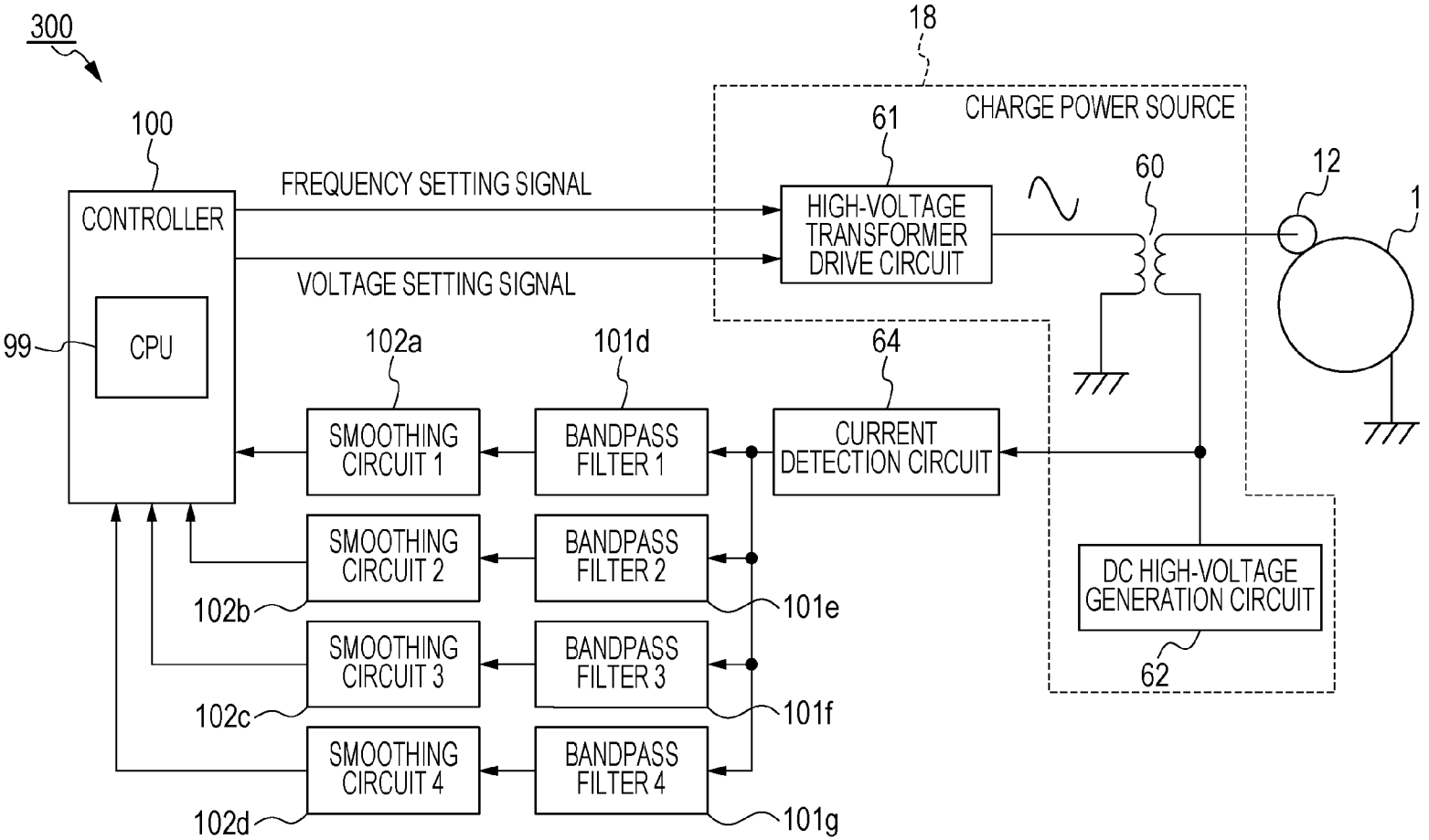
FIG. 16 is a diagram illustrating a schematic configuration of a control circuit that controls a discharge current amount of the image forming apparatus.

FIG. 16 is a diagram illustrating a schematic configuration of a control circuit 300 that controls a discharge current amount of the image forming apparatus 200.

In FIG. 16, four bandpass filters 101*d*, 101*e*, 101*f*, and 101*g* are provided. The bandpass filters 101*d* to 101*g* correspond to extraction units that extract current components in respective different predetermined frequency bands of the current waveform detected by the current detector. The bandpass filters 101*d* to 101*g* may each be an analog signal circuit or a digital signal circuit. In the embodiment, the A/D conversion is performed by using the sampling frequency of 44,100 Hz on the current waveform detected by the current detection circuit 64, and thereafter discharge current components are extracted in the digital signal processing. A digital signal processing circuit for removing current components other than the discharge current component is configured by using an ASIC. Note that a FPGA may also be used, and a high-general-purpose DSP may be operated in accordance with a program.

Specifically, a predetermined frequency band F calculated using any method described in the first to fifth embodiments is set for the bandpass filter 101*f*.

In addition, a frequency f applied to the high-voltage transformer is set as a passband in the bandpass filter 101*d* in the embodiment, and a frequency of ⅔ and a frequency of 4/3 of the frequency band F set for the bandpass filter 101*f* are set as the passbands for the bandpass filters 101*e* and 101*g*, respectively.

As described above, the plurality of bandpass filters are provided and have respective different frequencies serving as the passbands of the bandpass filters.

Smoothing circuits 102*a*, 102*b*, 102*c*, and 102*d* are peak hold circuits, and output signals are input to the controller 100 through digital-to-analog (D/A) conversion ports (not illustrated).

Also in the embodiment, the current detection circuit 64 provides the detected current waveform as illustrated in FIG. 3.

The waveform signal is input to the D/A conversion ports of the controller 100 through the bandpass filters (101*d* to 101*g*) that are set for the predetermined frequency bands and the smoothing circuit 102 that are the peak hold circuits.

The CPU 99 acquires output values from the smoothing circuits 102*a* to 102*d*.

The CPU 99 subsequently computes a measured discharge-current amount H (measured amount) (S209 in FIG. 7). In the embodiment, the measured discharge-current amount H takes on a value computed in accordance with Formula (1) below.

$$H=K_1\times V_1+K_2\times V_2+K_3\times V_3+K_4\times V_4+C \quad (1)$$

$V_1$: Output from bandpass filter 101*d*
$V_2$: Output from bandpass filter 101*e*
$V_3$: Output from bandpass filter 101*f*
$V_4$: Output from bandpass filter 101*g*
$K_1$, $K_2$, $K_3$, $K_4$, and C: Predetermined coefficients obtained based on experiments As described above, the measured discharge-current amount H is a linear sum of the output values of the bandpass filters 101*d* to 101*g* and represents an amount of a discharge current from the charge roller 12 to the photoconductor drum 1.

As described above, the measured amount corresponding to the discharge current amount is obtained as the linear sum of the output values of the bandpass filters. Even in a case where an amount of only positive current is detected due to a limited budget for inexpensive circuits or where the original waveform is distorted, $K_1$, $K_2$, $K_3$, $K_4$, and C based on the measured amount that well match the discharge current amount can be obtained from experiments. Control can be performed by setting $K_1$, $K_2$, $K_3$, $K_4$, and C to −0.1, 2.3, 0.3, −0.2, and −7.1, respectively.

In the embodiment, the measured amount is computed based on the linear sum of the output values of the bandpass filters. However, as long as such $K_1$, $K_2$, $K_3$, $K_4$, and C that well match the discharge current amount are set, the method for computing a measured amount is not limited to the method using the linear sum.

The measured discharge-current amount H is subsequently compared with the target discharge-current amount, and a voltage-correction set amount applied to the voltage setting signal is computed so that the difference between the measured discharge-current amount H and the target discharge-current amount can be decreased (S210 in FIG. 7). The voltage setting signal (correction value) having undergone the correction is output to the high-voltage transformer drive circuit 61 (S211 in FIG. 7). The voltage setting signal correction is continued at fixed sampling intervals until the AC charge is terminated.

Figure 17A:
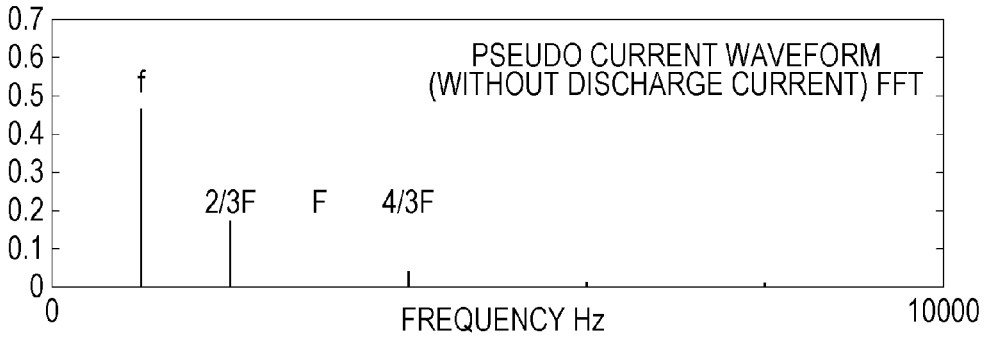
FIGS. 17A and 17B are graphs each illustrating a detected current waveform having undergone Fourier transformation.
Figure 17B:
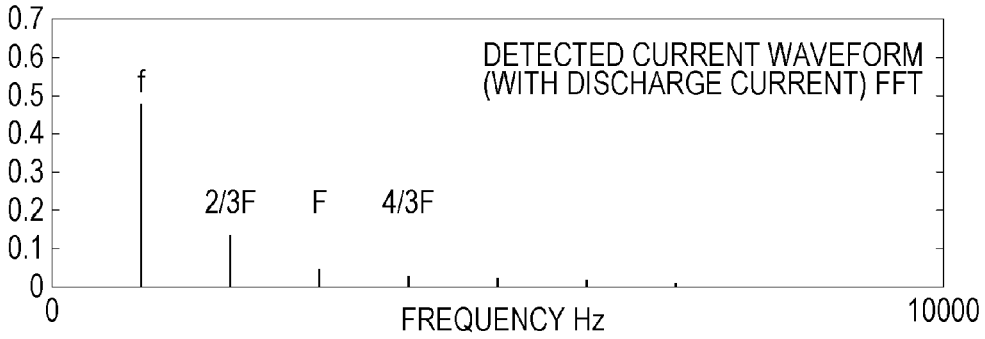

FIG. 17A illustrates a pseudo current waveform (without discharge current) having undergone Fourier transformation, and FIG. 17B illustrates a detected current waveform (with discharge current) having undergone Fourier transformation. In FIGS. 17A and 17B, the vertical axis represents frequency component, and the horizontal axis represents frequency.

In FIGS. 17A and 17B, a difference between the two waveforms is mainly observed at a peak subsequent to the frequency of ⅔ of the frequency band F set for the bandpass filter 101*f*. The difference corresponds to the waveform of the discharge current.

Accordingly, if a predetermined frequency component of the detected current waveform is observed in real time, the component of the discharge current amount can be extracted. By utilizing this and in consideration for distortion or the like at the time of current detection, Formula (1) uses the linear sum of the output values of the bandpass filters to calculate the discharge current amount H. The coefficients in Formula (1) may be obtained from experiments depending on the image forming apparatus.

In the configuration as described above, the plurality of frequency bands of the bandpass filters are set as in the first to fifth embodiments. The discharge current amount can thereby be obtained with further higher accuracy, and the AC voltage applied to the charging member can be controlled with higher accuracy.

OTHER EMBODIMENTS

In each of the first to seventh embodiments, the example in which the frequency band of the bandpass filter is set based on the use amount information and the environmental information has been described. However, the frequency band of the bandpass filter may be set based on only one of the use amount information and the environmental information.

According to the invention, even in a case where the environment factor is changed, the AC voltage applied to the charging member can be controlled with high accuracy.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-002615 filed Jan. 8, 2015, which is hereby incorporated by reference herein in its entirety.

What is claimed is:

1. An image forming apparatus comprising:

an image-bearing member;

a charging member configured to charge the image-bearing member by receiving a charge voltage in which a direct-current voltage and an alternating-current voltage are superposed on each other;

a power source configured to apply a voltage to the charging member;

a toner-image forming unit configured to form a toner image on the image-bearing member charged by the charging member;

a detector configured to detect a current flowing through the charging member when the power source applies the charge voltage to the charging member;

an extraction unit configured to extract, from the current detected by the detector when the charge voltage is applied to the charging member, a current in a frequency band including a discharge current component;

an adjustment unit configured to adjust the alternating-current voltage based on the current extracted by the extraction unit;

an acquisition unit configured to acquire environmental information; and a setting unit configured to set, based on the environmental information acquired by the acquisition unit, a frequency band for extraction performed by the extraction unit.

2. The image forming apparatus according to claim 1, wherein the acquisition unit acquires temperature information, the setting unit sets a median value of the frequency band to a first frequency in a case where a temperature acquired by the acquisition unit is a first temperature, and the setting unit sets the median value of the frequency band to a second frequency higher than the first frequency in a case where the temperature acquired by the acquisition unit is a second temperature higher than the first temperature.

3. The image forming apparatus according to claim 1, wherein the acquisition unit acquires relative humidity information, the setting unit sets a median value of the frequency band to a first frequency in a case where a relative humidity acquired by the acquisition unit is a first humidity, and the setting unit sets the median value of the frequency band to a second frequency higher than the first frequency in a case where the relative humidity acquired by the acquisition unit is a second humidity higher than the first humidity.

4. The image forming apparatus according to claim 1, wherein the acquisition unit acquires absolute humidity information, the setting unit sets a median value of the frequency band to a first frequency in a case where an absolute humidity acquired by the acquisition unit is a first humidity, the setting unit sets the median value of the frequency band to a second frequency higher than the first frequency in a case where the absolute humidity acquired by the acquisition unit is a second humidity higher than the first humidity.

5. The image forming apparatus according to claim 1, further comprising a use-amount acquisition unit configured to acquire use amount information of the image-bearing member, wherein, based on the use amount information acquired by the use-amount acquisition unit and the environmental information acquired by the acquisition unit, the setting unit sets the frequency band for extraction performed by the extraction unit.

6. The image forming apparatus according to claim 5, wherein the setting unit sets a median value of the frequency band to a third frequency in a case where the use-amount acquisition unit acquires a first use amount, and the setting unit sets the median value of the frequency band to a fourth frequency higher than the third frequency in a case where the use-amount acquisition unit acquires a second use amount larger than the first use amount.

7. The image forming apparatus according to claim 5, wherein the use amount information of the image-bearing member that is acquired by the use-amount acquisition unit is any one of a total number of pages that have undergone image forming, a total time in which the image-bearing member rotates, and a total time in which the charge voltage is applied to the charging member.

8. The image forming apparatus according to claim 5, wherein the setting unit sets a median value of the frequency band to a fifth frequency in a case where the current detected by the detector has a first current value as a result of detection performed by the detector, the setting unit sets the median value of the frequency band to a sixth frequency lower than the fifth frequency in a case where the current detected by the detector has a second current value higher than the first current value.

9. The image forming apparatus according to claim 1, wherein the extraction unit extracts currents in different frequency bands, and the setting unit sets the different frequency bands for respective extracted currents.

10. A method for an image forming apparatus having an image-bearing member, the method comprising:

charging, via a charging member, the image-bearing member by receiving a charge voltage in which a direct-current voltage and an alternating-current voltage are superposed on each other;

applying a voltage to the charging member from a power source;

forming, via a toner-image forming unit, a toner image on the image-bearing member charged by the charging member;

detecting, via a detector, a current flowing through the charging member when the power source applies the charge voltage to the charging member;

extracting, via an extraction unit and from the current detected by the detector when the charge voltage is applied to the charging member, a current in a frequency band including a discharge current component;

adjusting, via an adjustment unit, the alternating-current voltage based on the current extracted by the extraction unit;

acquiring, via an acquisition unit, environmental information; and setting, via a setting unit and based on the environmental information acquired by the acquisition unit, a frequency band for extraction performed by the extraction unit.

* * * * *